United States Patent [19]

Aileo

[11] Patent Number: 4,884,301

[45] Date of Patent: Dec. 5, 1989

[54] COMBINATION CHINSTRAP-NAPESTRAP ASSEMBLY FOR HELMET

[75] Inventor: Jackson A. Aileo, Carbondale, Pa.

[73] Assignee: Gentex Corporation, Carbondale, Pa.

[21] Appl. No.: 205,949

[22] Filed: Jun. 13, 1988

[51] Int. Cl.[4] ..... A42B 3/02; A42B 7/00

[52] U.S. Cl. ..... 2/421; 2/6

[58] Field of Search ..... 2/6, 416, 421, 425

[56] References Cited

U.S. PATENT DOCUMENTS

| | | | |
|---|---|---|---|
| 2,814,043 | 11/1957 | Alesi | 2/421 |
| 2,846,683 | 8/1958 | Dye et al. | 2/421 |
| 4,075,714 | 2/1978 | Ryder et al. | 2/6 |
| 4,551,861 | 11/1985 | Marchello | 2/425 |
| 4,646,368 | 3/1987 | Infusino et al. | 2/421 |
| 4,703,879 | 11/1987 | Kastendieck et al. | 2/6 X |
| 4,741,054 | 5/1988 | Mattes | 2/421 |

*Primary Examiner*—Wm. Carter Reynolds

*Attorney, Agent, or Firm*—Shenier & O'Connor

[57] ABSTRACT

A one-piece chinstrap-napestrip assembly for a helmet in which a pair of napestraps secured to the nap portion of the helmet interior at laterally spaced locations extend around the lower periphery of the helmet, crossing each other, and pass outwardly through slots formed in the front of the helmet to receive the ends of an adjustable chinstrap. Adjustment of the chinstrap at the front of the assembly produces a simultaneous adjustment of the crossing napestrap portions at the rear of the assembly without the necessity for independent adjustment of the latter strap portions. A padded napestrap retainer secured by straps to the same locations on the nape portion of the helmet is formed with intersecting passages for receiving the crossing strap portions. The retainer reduces chafing and urges the crossing napestrap portions toward the rear of the helmet when the chinstrap is released to facilitate donning and doffing.

24 Claims, 5 Drawing Sheets

FIG. 9
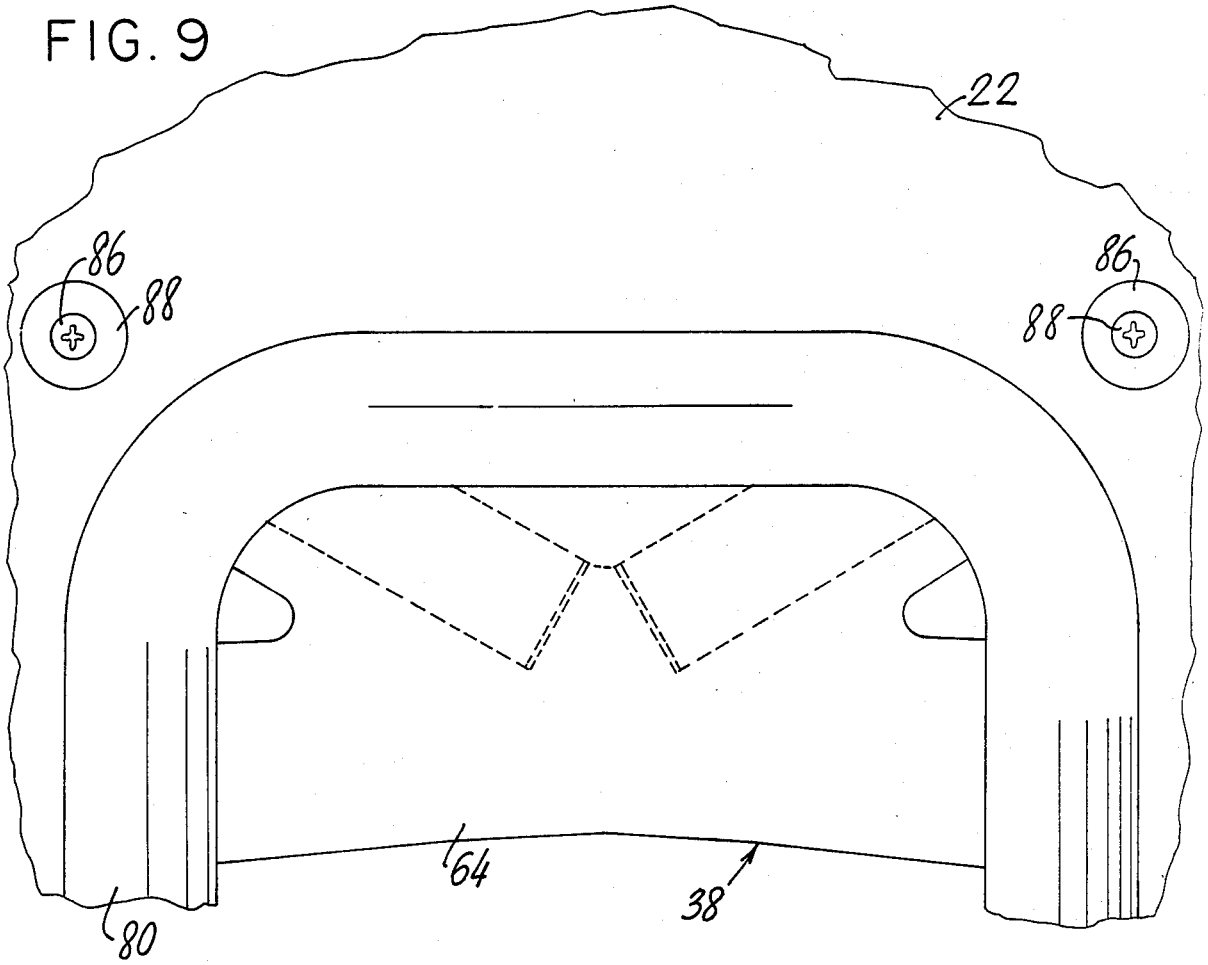
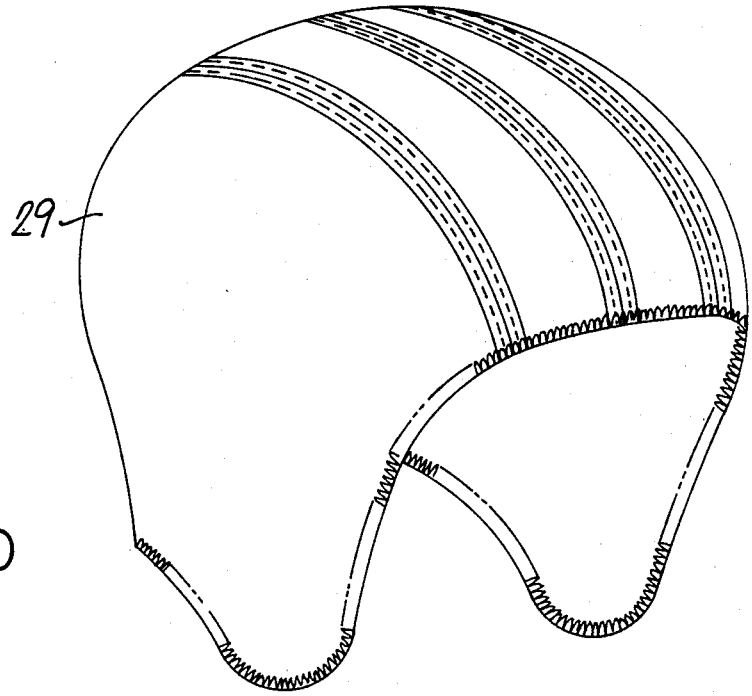
FIG. 10

COMBINATION CHINSTRAP-NAPESTRAP ASSEMBLY FOR HELMET

FIELD OF THE INVENTION

This invention relates to a combination chinstrap-napestrap assembly for use in a protective helmet such as a flyer's helmet or the like.

BACKGROUND OF THE INVENTION

Protective helmets for use in military or other applications such as aboard an aircraft are well known in the art. It is important in such applications that the helmet be securely mounted on the wearer's head. Otherwise, the helmet may shift its position or even come off in the case of windblast, for example. Previous helmets generally have an adjustable chinstrap as well as a napestrap for preventing shifting of the helmet relative to these portions of the wearer's head. The necessity of separately adjusting the chinstraps and napestraps of these helmets is an obvious inconvenience.

Recently there has appeared a helmet having a one-piece chinstrap-napestrap assembly in which a pair of napestraps secured to opposite sides of the nape region of the helmet interior cross each other to extend around the lower periphery of the helmet and pass outwardly through slots formed in the front of the helmet to receive the ends of a chinstrap. Adjustment of the chinstrap at the front of the assembly produces a simultaneous adjustment of the crossing napestrap portions at the rear of the assembly without the necessity for independent adjustment of the latter strap portions. Although the one-piece assembly described above overcomes some of the deficiencies of the prior assemblies described further above, there nevertheless remains room for improvement. Not only can the crossing strap portions cause chafing, but they do not positively define the spacing between the wearer's neck and the back of the helmet.

SUMMARY OF THE INVENTION

One object of my invention is to provide a mounting assembly for a helmet that reliably positions the helmet on the wearer's head.

Another object of my invention is to provide a mounting assembly that is easy to use.

Still another object of my invention is to provide a mounting assembly that does not require separate adjustment of a chinstrap and napestrap.

A further object of my invention is to provide a mounting assembly that is comfortable.

Still another object of my invention is to provide a mounting assembly that facilitates donning and doffing of the helmet.

Other and further objects will be apparent from the following description.

In general, my invention contemplates, in a helmet assembly of the type described above in which a pair of napestraps secured to the rear of the helmet shell on opposite sides thereof cross each other in the nape area of the helmet, the improvement of providing means for retaining the crossing strap portions. Preferably, the retaining means comprises a generally X-shaped padded flexible member formed with intersecting passages for receiving the crossing strap portions, which is secured along with the napestraps to the rear of the helmet shell.

The retaining means of my invention accomplishes several objectives. First, it provides a larger effective area of contact between the crossing strap portions and the wearer's neck, reducing chafing. Second, the retainer supports positively define a relaxation position, slightly spaced from the rear of the helmet, to which the retainer, and thus the crossing napestrap portions, return when the chinstrap is released. This positioning of the crossing strap portions adjacent to the nape of the helmet facilitates donning and doffing of the helmet.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 9 is an enlarged fragmentary rear elevation of the helmet assembly of FIG. 1.

FIG. 10 is a perspective view of the skullcap used with the helmet assembly shown in FIG. 1.

DESCRIPTION OF THE PREFERRED EMBODIMENT

Figure 1:
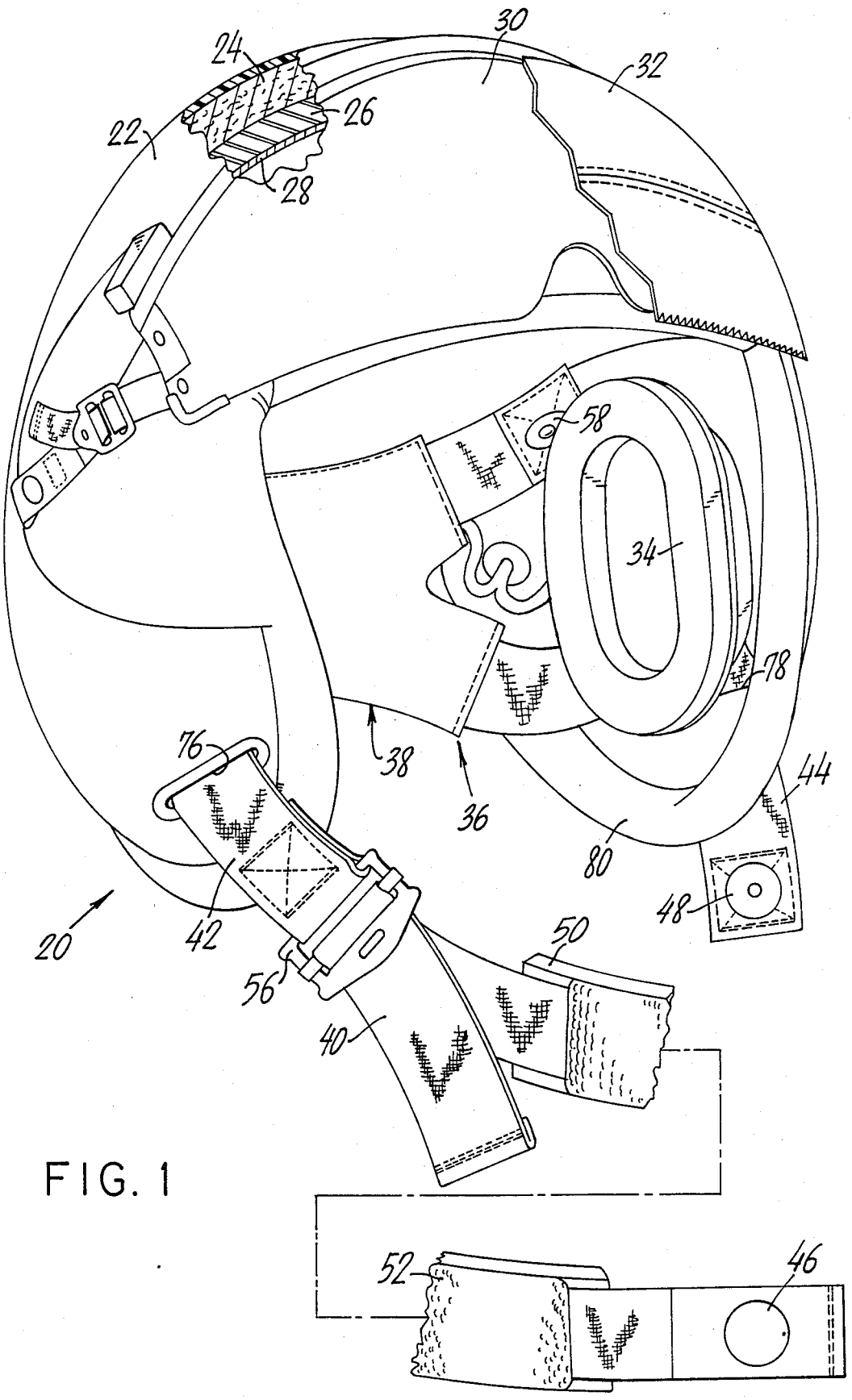
FIG. 1 is a perspective view of a helmet assembly incorporating my combination chinstrap-napestrap assembly.

Referring now to FIG. 1, a helmet assembly, indicated generally by the reference numeral 20, incorporating my combination chinstrap-napestrap assembly includes a rigid shell 22, preferably made of fiberglass cloth molded with epoxy resin. A foam edgeroll 80 around the periphery of shell 22 is covered with soft leather for comfort and stability. Shell 22 has secured to its inner surface an energy-absorbing liner 24 for reducing the impact energy transmitted to the wearer's head. Preferably liner 24 comprises 0.5-inch-thick polystyrene foam. A thermoplastic liner 26 is sandwiched between energy absorbing layer 24 and an inner cloth cover 28. Thermoplastic liner 26, which is described in detail in Grick et al U.S. Pat. No. 4,432,099, consists of multiple layers of thermoplastic (not shown in FIG. 1) that have been formed to create protrusions that partially collapse when heat-softened to conform to the contour of the individual's head. Referring to FIG. 10, a skullcap 29 may be worn between the wearer's head and cover 28 to absorb perspiration and enhance personal comfort.

Helmet assembly 20 also includes a visor assembly 30, which may be either a single-visor assembly as shown or, if desired, a dual-visor assembly such as that shown in the copending application of applicant Jackson A. Aileo et al, Ser. No. 045,410, filed May 4, 1987, entitled "Dual-Visor Assembly for Helmet", now U.S. Pat. No. 4,847,920. A cover 32 may be optionally secured over visor 30 when the visor is not in use to protect it from damage. Helmet assembly 20 also includes a pair of earcups 34 such as those described in the copending application of applicant Jackson A. Aileo et al, Ser. No. 182,851, filed Apr. 18, 1988, entitled "Energy-Absorbing Earcup Assembly".

Figure 2:
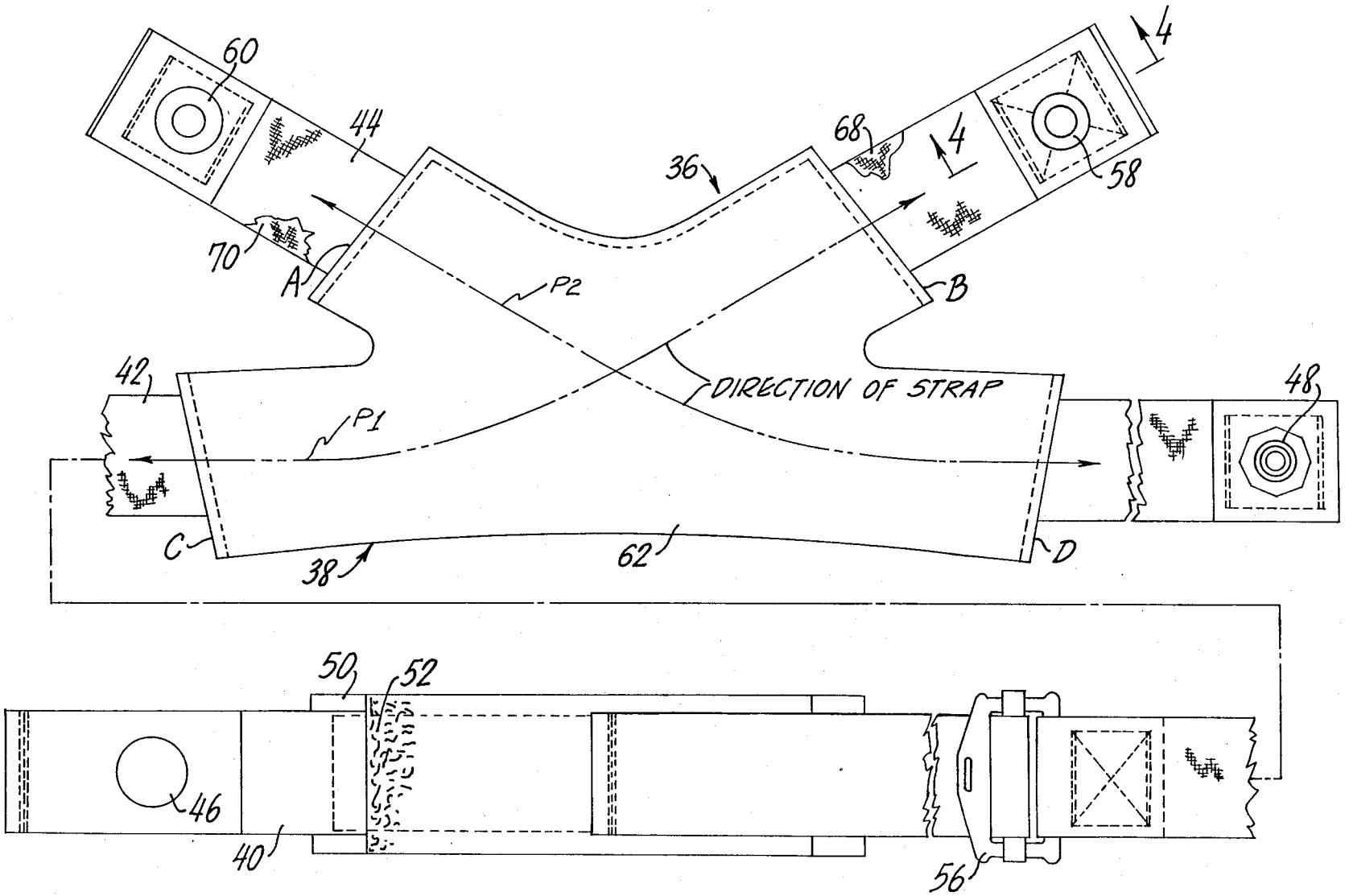
FIG. 2 is an enlarged front elevation of the chinstrap-napestrap assembly of the helmet assembly shown in FIG. 1.
Figure 3:
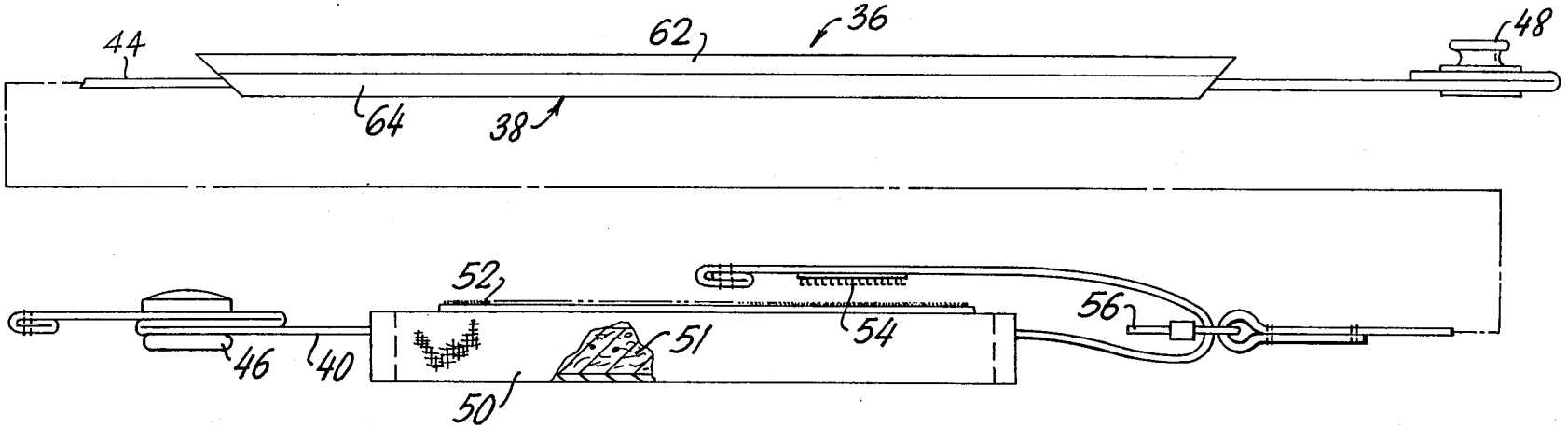
FIG. 3 is a bottom plan of the chinstrap-napestrap assembly of FIG. 2.
Figure 8:
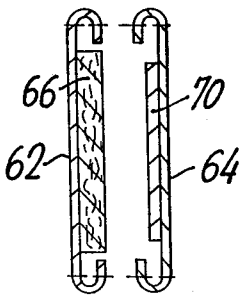
FIG. 8 is a section of the retainer of FIG. 6 in partially assembled form, along line 8—8.
Figure 7:
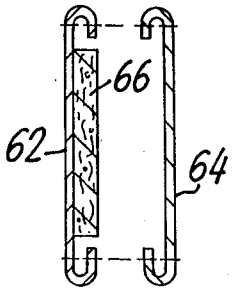
FIG. 7 is a section of the retainer of FIG. 6 in partially assembled form, along line 7—7.

Referring now also to FIGS. 2 and 3, the combination chinstrap-napestrap assembly of the present invention, indicated generally by the reference numeral 36, includes an X-shaped retainer indicated generally by the reference numeral 38.

Retainer 38 comprises a front cover 62 and a rear cover 64 comprising a suitable soft, flexible material such as leather, stitched together to form a pair of intersecting passages P1 and P2 (FIG. 2). Passage P1 has an upper right end opening B and a lower left end opening C; passage P2 has an upper left end opening A and a lower right end opening D. Passages P1 and P2 receive crossing napestraps 42 and 44 formed of any suitable material such as nylon webbing. Napestrap 42 has a first end extending out of opening B of passage P1 and receiving an eyelet 58; this first end of napestrap 42 is secured to the rear of the helmet shell 22 on its left side through eyelet 58 in a manner to be described. The second end of napestrap 42 passes through a slot 76 formed in helmet shell 22 on its right side to receive a buckle 56.

Buckle 56 receives one end of a chinstrap 40, which may be formed of a webbing similar to that of napestraps 42 and 44. Chinstrap 40 carries a cloth cover 50 within which is disposed a chinstrap pad 51 (FIG. 3) formed of a resilient cellular foam such as polyurethane foam. Cover 50 carries a pile fastener strip 52 (e.g., the one sold under the trademark Velcro) adapted to mate with a hook fastener strip 54 carried at the first end of chinstrap 40 to adjust the effective length of the chinstrap. Chinstrap 40 carries at its second end a female snap fastener 46.

In a similar manner, napestrap 44 has a first end, extending out of opening A of passage P2 of retainer 38, which receives an eyelet 60 similar to eyelet 58. Napestrap 44 is secured to the rear of the helmet shell 22 on its right side through eyelet 60 in a manner to be described below. The second end of napestrap 44, extending out of opening D from passage P2, passes through a slot 78, similar to slot 76, formed at the front of the helmet shell 22 on its left side. A male snap fastener 48 carried by the portion of napestrap 44 extending through slot 78 mates with female snap fastener 46 to secure the chinstrap 40 around the chin of the wearer. Preferably, fasteners 46 and 48 are unidirectional fasteners such as disclosed in my prior patent U.S. Pat. No. 3,491,372, which release only when the portion of chinstrap 40 to the left of fastener 46 (FIGS. 2 and 3) is pulled upwardly from fastener 48.

Figure 5:
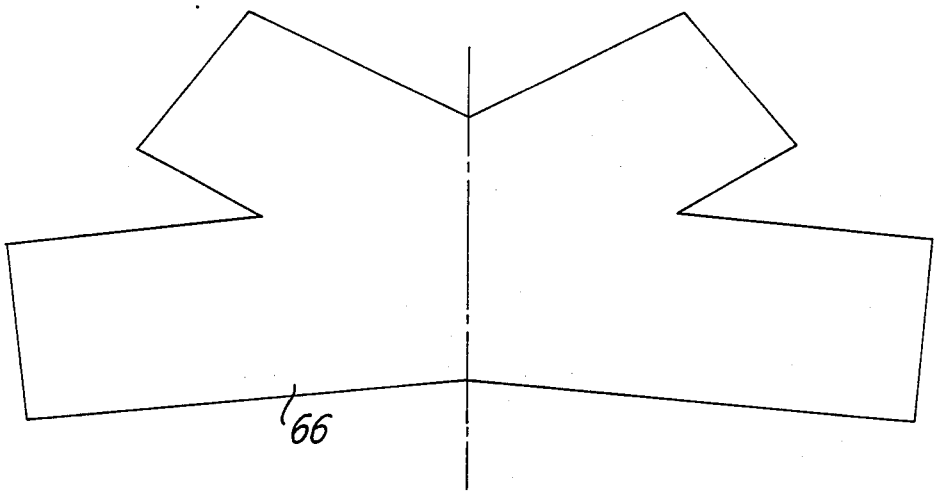
FIG. 5 is a front elevation of the retainer pad of the chinstrap-napestrap assembly shown in FIG. 2.
Figure 6:
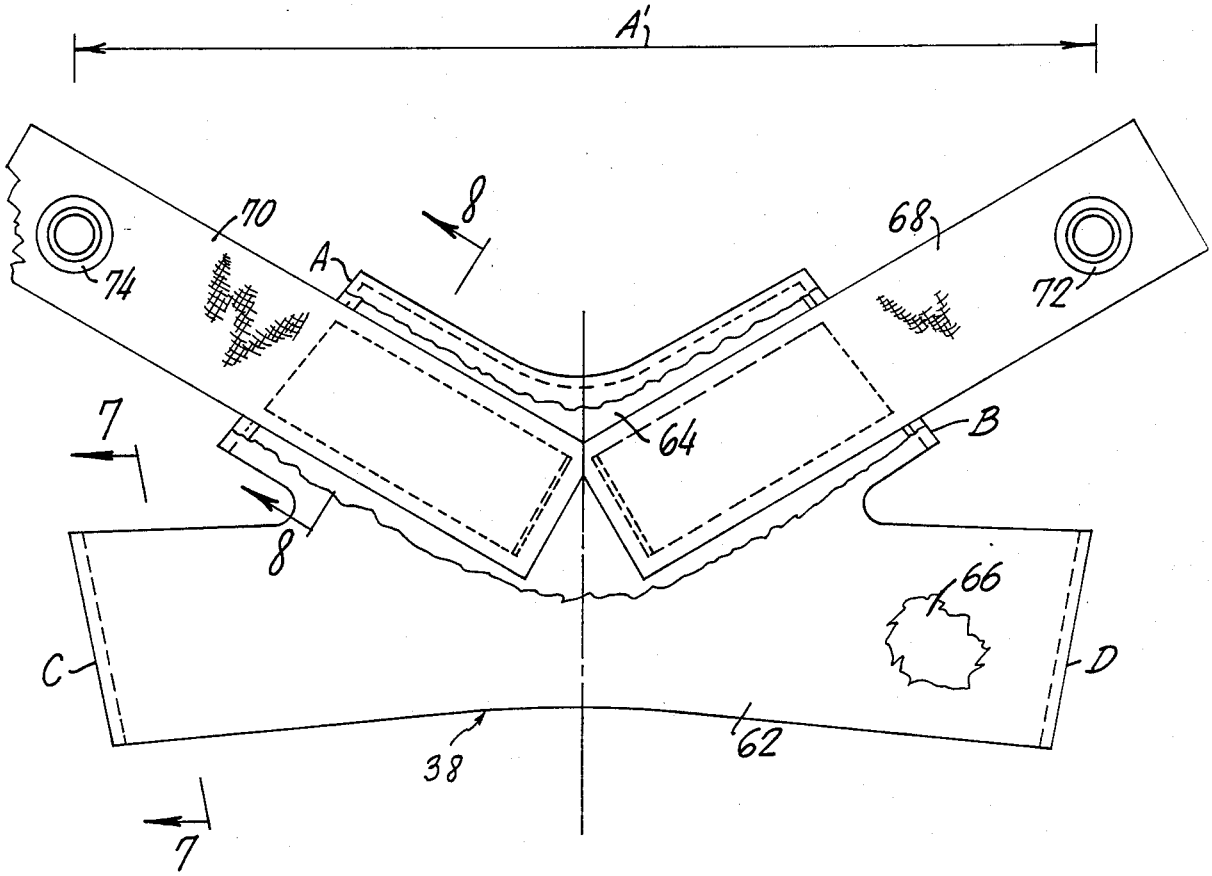
FIG. 6 is a front elevation with parts broken away of the retainer of the chinstrap-napestrap assembly shown in FIG. 2.

Referring now to FIGS. 5 to 8, retainer 38 has adhered to the inside surface of the cover front 62 a foam pad 66, the outline of which is shown in FIG. 5. As shown in FIG. 6, retainer 38 also has secured to the inside surface of the back 64 respective left and right webbing portions 68 and 70, having eyelets 72 and 74 at their ends similar to eyelets 58 and 60 of napestraps 42 and 44. Webbing portions 68 and 70 are preferably formed from a single piece of material that has been transversely slit at its midpoint as shown in FIG. 6.

Figure 4:
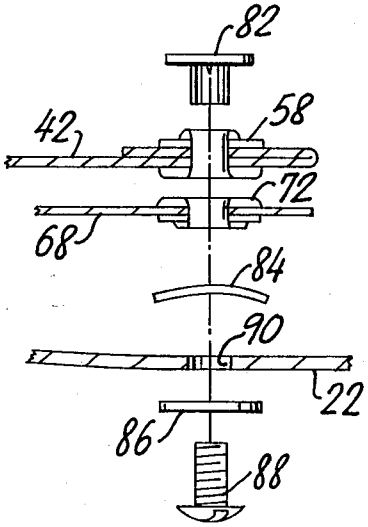
FIG. 4 is a fragmentary exploded section of the chinstrap-napestrap assembly of FIG. 2, along line 4—4 thereof.

Referring now to FIGS. 4 and 9, napestrap 42 and retainer strap 68 are secured to the left side of the helmet shell 22. A screw 88 passes through a bore 90 in the helmet shell 22 and eyelets 72 and 58 of straps 68 and 42 to receive a T-nut 82 (not shown in FIG. 1). Screw 88 carries a spring washer 84 inside of helmet shell 22 and a regular washer 86 outside of helmet shell 22. Napestrap 44 and retainer strap 70 are similarly secured to the right side of the helmet shell. The distance A' (FIG. 6) between the left and right mounting locations is such that straps 68 and 70 are fairly taut so as to suspend retainer 38 at a slight spacing from the rear edgeroll 80. As shown in FIG. 9, the mounting screws 88 are so located as to suspend retainer 38 below the rear edgeroll 80.

Whenever chinstrap 40 is loosened or released from napestrap 44, retainer straps 68 and 70 urge retainer 38 into its relaxed position at the rear of the helmet shell 22. With the retainer 38 and the crossing portions of napestraps 42 and 44 so positioned, the wearer can readily don the helmet assembly 20 without interference from the napestraps. Subsequent tightening of the chinstrap 40 or fastening to napestrap 44 produces a corresponding tension in the napestraps 42 and 44, urging the lower portion of retainer 38 into engagement with the nape of the wearer's neck. Owing to the relatively large surface area of retainer 38, any chafing is minimized. When the wearer again loosens or disconnects chinstrap 40 to remove the helmet assembly 20, the lower portion of the retainer 38 returns to its relaxed position adjacent to the rear edgeroll 80 to allow the wearer to remove the helmet assembly without interference from the napestraps 42 and 44.

It will be seen that I have accomplished the objects of my invention. My combination chinstrap-napestrap assembly reliably positions a helmet on a wearer's head, and is easy to use because it does not require separate adjustment of a chinstrap and napestrap. My assembly is comfortable, since it minimizes chafing from the napestraps at the rear of the helmet. Finally, my assembly facilitates donning and doffing of the helmet.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A helmet assembly including in combination a shell, a pair of straps each having first and second ends, means for securing the first end of each of said straps to the rear of said shell on opposite sides thereof, means for interconnecting the second ends of said straps, means on each side of the front of said shell for receiving an intermediate portion of one of said straps, each of said straps being secured to the rear of said shell on one side and being received at the front of said shell on the other side so as to cross the other strap in the nape area of said shell, means for retaining the crossing portions of said straps, and means independent of said straps for urging said retaining means toward the rear of said shell, said retaining means being movable into engagement with the nape of the wearer's neck upon tensioning of said straps against the action of said urging means.

2. An assembly as in claim 1 in which said retaining means comprises a pad for receiving said crossing strap portions.

3. An assembly as in claim 1 in which said urging means secures the retaining means to the rear of said shell on opposite sides thereof.

4. An assembly as in claim 1 in which said urging means secures the retaining means to the rear of said shell at the same locations as said straps.

5. An assembly as in claim 1 in which said urging means comprises a flexible member securing said retaining means to the rear of said shell.

6. An assembly as in claim I in which said urging means comprises a pair of flexible members securing said retaining means to the rear of said shell at locations on opposite sides thereof.

7. An assembly as in claim 6 in which said flexible members tension said retaining means between said locations.

8. A helmet assembly including in combination a shell, a pair of straps each having first and second ends, means for securing the first end of each of said straps to the rear of said shell on opposite sides thereof, means for interconnecting the second ends of said straps, means on each side of the front of said shell for receiving an intermediate portion of one of said straps, each of said straps being secured to the rear of said shell on one side and being received at the front of said shell on the other side so as to cross the other strap in the nape area of said shell, and means at the rear of said shell for retaining the crossing portions of said straps, said retaining means being formed with intersecting passages for receiving said crossing strap portions.

9. An assembly as in claim 8 in which each of said passages has an upper end on one side of said shell and a lower end on the other side of said shell.

10. An assembly as in claim 9 in which the first end of each of said straps is adjacent to the upper end of the passage receiving said strap.

11. An assembly as in claim 10 including means for securing the portions of said retaining means forming the upper ends of said passages to the rear of said shell.

12. An assembly as in claim 11 in which said portions of said retaining means are secured to the rear of said shell at the same locations as said straps.

13. A combination chinstrap-napestrap assembly for use with a helmet shell including in combination a pair of napestraps each having first and second ends, means for securing the first end of each of said napestraps to the rear of said shell on opposite sides thereof, means for interconnecting the second ends of said straps, each of said straps being adapted to cross the other strap in the nape area of said shell, and means for retaining the crossing portions of said straps, said retaining means being formed with intersecting passages for receiving said crossing strap portions.

14. An assembly as in claim 13 in which each of said passages has an upper end on one side of said retaining means and a lower end on the other side of said retaining means.

15. An assembly as in claim 14 in which the first end of each of said straps is adjacent to the upper end of the passage receiving said strap.

16. An assembly as in claim 15 including means for securing the portions of said retaining means forming the upper ends of said passages to the rear of said shell.

17. An assembly as in claim 16 in which said portions of said retaining means are adapted to be secured to the rear of said shell at the same locations as said straps.

18. A retainer for use with a helmet assembly having crossing napestrap portions at the rear of a helmet shell, comprising a flexible member formed with intersecting passages for receiving said strap portions.

19. A retainer as in claim 18 in which said flexible member includes a pad.

20. A retainer as in claim 18 including means for securing said member to the rear of said shell.

21. A retainer for use with a helmet assembly having crossing napestrap portions at the rear of a helmet shell, comprising an elongated flexible member having a first end and a second end, said member being formed with a passage between said ends for receiving said crossing napestrap portions, and respective retainer straps attached to said member at said ends for securing said member to the rear of said shell independently of said napestraps.

22. A retainer as in claim 21 in which said member comprises a pad.

23. A retainer as in claim 21 for which said member is formed with intersecting passages in receiving said crossing napestrap portions.

24. A retainer as in claim 23 in which each of said retainer straps is attached to said member at the end of one of said passages.

* * * * *